United States Patent [19]

Bassi et al.

[11] Patent Number: 4,777,491

[45] Date of Patent: Oct. 11, 1988

[54] ANGULAR-DIVERSITY RADIATING SYSTEM FOR TROPOSPHERIC-SCATTER RADIO LINKS

[75] Inventors: Cesare Bassi; Elio Deponti, both of Milan, Italy

[73] Assignee: GTE Telecommunicazioni, S.p.A., Milan, Italy

[21] Appl. No.: 64,146

[22] Filed: Jun. 18, 1987

[30] Foreign Application Priority Data

Jul. 18, 1986 [IT] Italy ..... 21168 A/86

[51] Int. Cl.[4] ..... H01Q 19/14

[52] U.S. Cl. ..... 343/779; 343/781 GA; 343/781 P

[58] Field of Search ..... 343/779, 781 CA, 781 P

[56] References Cited

U.S. PATENT DOCUMENTS

| | | | |
|---|---|---|---|
| 3,307,183 | 2/1967 | Adam | 343/781 GA |
| 4,017,865 | 4/1977 | Woodward | 343/781 GA |
| 4,355,314 | 10/1982 | Ohm | 343/779 |
| 4,573,051 | 2/1986 | Farina | 343/781 P |

FOREIGN PATENT DOCUMENTS

| | | | |
|---|---|---|---|
| 0059343 | 8/1982 | European Pat. Off. | 343/779 |
| 2108326 | 5/1983 | United Kingdom | 343/781 GA |

*Primary Examiner*—William L. Sikes
*Assistant Examiner*—Hoanganh Le
*Attorney, Agent, or Firm*—Jeffrey P. Morris

[57] ABSTRACT

An angular-diversity radiating system is described for tropospheric-scatter radio links which accomplishes a symmetrical Cassegrain optic in transmission and is parabolic with a central focus in reception, respectively. This is accomplished by a subreflector formed of parallel metal conductors and shaped with a hyperbolic profile which is centered on the axis of the main reflector at a predetermined distance between the transmitting horn and the receiving horns. The electromagnetic waves leaving the transmitting horn and directed toward the subreflector are polarized with the electric field vector parallel to the metal conductors of the subreflector such as to be reflected toward the main reflector which reradiates them. The electromagnetic waves received are polarized orthogonally to the transmitted waves and thus pass undisturbed through the subreflector to reach the receiving horns. The invention also permits continuous adjustment of the vertical distance between the receiving horns in order to optimize the diversity angle.

14 Claims, 2 Drawing Sheets

ANGULAR-DIVERSITY RADIATING SYSTEM FOR TROPOSPHERIC-SCATTER RADIO LINKS

BACKGROUND OF THE INVENTION

1. Field of the Invention

The present invention relates to the field of tropospheric scatter radio links and more particularly to a radiating system with angular diversity comprising a main reflector, a subreflector, a transmitting horn and at least two receiving horns.

2. Description of the Prior Art

It is known that to establish microwave radio links beyond the horizon it is possible to use radiating systems which utilize the scattering of electromagnetic waves by the troposphere.

It is also known that the troposphere displays irregularities generally considered as bubbles or layers which vary continuously in number, form and position with resulting variation of the refraction index and diffusion angle. When such irregularities are illuminated by a beam of electromagnetic waves from a transmitting antenna they scatter the electromagnetic energy in all directions but predominantly within a cone having as its axis the direction of transmission.

It is clear that with such links path attenuation is much higher than that found in links with antennas which remain in a field of mutual visibility since the propagation mechanism is different. In addition, in troposcatter radio links there are met sudden deep fadings of the intensity of the signal received due mainly to random movements of the irregularities of the troposphere.

Diversity techniques are known which are used to avoid the aformentioned problems with tropospheric propagation, i.e. spatial, frequency and angular diversity. Diversity can also be simple or multiple. In case of multiple diversity suitable combinations of the different diversity techniques have been achieved.

Spatial diversity consists of transmitting the same signal with two antennas appropriately spaced and directed and in using two other antennas similarly arranged for reception. The basic assumption on which this technique is based is that fadings of signal intensity which appear on the two beams are poorly correlated.

Frequency diversity differs from spatial diversity in that the signal is radiated on a single beam but with two carriers appropriately spaced as to frequency so as to make intensity fadings of the two signals received uncorrelated.

Angular diversity consists of radiating electromagnetic power in a single beam and in equipping the receiving antenna with two receiving horns appropriately spaced from each other in such a manner that the single transmitted beam is received in two different directions forming a certain angle called diversity angle and giving rise to two signals as independent as possible from the point of view of tropospheric propagation. It is thus possible to effect in reception a combination of the two signals received such that the combination signal intensity or the signal-to-noise ratio of the combination is always kept sufficiently high.

It is also known that with angular diversity systems there is the problem of optimizing the diversity angle which, as mentioned above, depends on the distance between the receiving horns. As the diversity angle increases so does the statistical independence between the intensity fadings which appear on the two received signals, with a resulting system improvement. But antenna gain is simultaneously reduced because of defocusing.

It is also known that radiating systems in general and those with angular diversity in particular accomplish the transmitting part and the receiving part on the same antenna and bring about decoupling of the transmitting signals from the receiving signals by using different frequencies or by means of polarizations on the orthogonal planes or with a combination of these decoupling criteria. As concerns polarization, there are radiating systems with single polarization and radiating systems with double polarization.

Radiating systems with double-polarization angular diversity possess a first horn generally placed in the focus of the antenna parabola used for both transmitting and receiving and a second horn arranged parallel to the first used only for receiving.

The drawbacks of systems of this type are due mainly to the complexity of antenna horns. In general they include for effecting decoupling or discrimination between the two orthogonal polarizations many elements which lead to considerable occupied space with the resulting reduction of efficiency of the antenna compared with theoretical efficiency.

An example of a known tropospheric radiating systems with single-polarization angular diversity is British Pat. No. 1,178,782 granted Jan. 21, 1970 to the Marconi Company Limited which utilizes a parallel-conductor screen to separate the reception polarization from the transmission polarization, which are orthogonal to each other.

The above system described in the aforementioned British patent makes use of an offset paraboloid to permit the beam leaving the transmitting horn placed in the focus of said paraboloid to reach the surface of the antenna, avoiding blocking effects by the receiving horns which are outside the field of illumination.

The drawbacks of the angular-diversity radiating system described are due mainly to the fact that in such a system the primary illumination axis forms an offset angle with the orthogonal optical axis at the antenna aperture plane. As is known, offset systems provide performance generally poorer than symmetrical systems and in particular have less efficiency in crossed polarization because as is known for efficiency diminishes as antenna curvature increases, i.e. for smaller focus-to-diameter ratios and especially for geometrical dissymetries of the optical system.

The drawbacks mentioned hereinbefore are all the more serious in prior art systems which, as described hereinbefore, use a parallel-conductor screen to separate the two linear polarizations which are othogonal to each other. As a result of less efficiency under crossed polarization, a part of the electromagnetic power of the transmitted beam leaves the antenna with a polarization orthogonal to that which it should have. This part of the power, after reaching the receiving antenna, passes through the parallel-conductor screen and reaches the transmitting horn while it should be reflected from the screen toward the receiving horns.

Accordingly the primary object of the present invention is to overcome the aforementioned drawbacks of the prior art and provide an angular-diversity radiating system which is symmetrical, permits the use of antenna horns which are easy to fabricate, and has good efficiency under crossed polarization, and permits adjustment of the distance between the receiving horns to optimize the diversity angle.

SUMMARY OF THE INVENTION

The present invention provides an angular-diversity radiating system having a main reflector, a subreflector, a transmitting horn and at least two receiving horns wherein the subreflector is centered on the optical axis of said main reflector, the transmitting horn is arranged between the main reflector and said subreflector with its longitudinal symmetry axis coinciding with the optical axis and with the center of its radiating aperture placed at a first predetermined distance from the subreflector. The receiving horns are placed on the side opposite that of the subreflector of the transmitting horn and the receiving horns are arranged with their longitudinal symmetry axis parallel to the optical axis.

Other advantages of the present invention will be made clear by the description of a preferred embodiment including the drawings, wherein:

DESCRIPTION OF THE PREFERRED EMBODIMENT

Figure 1:
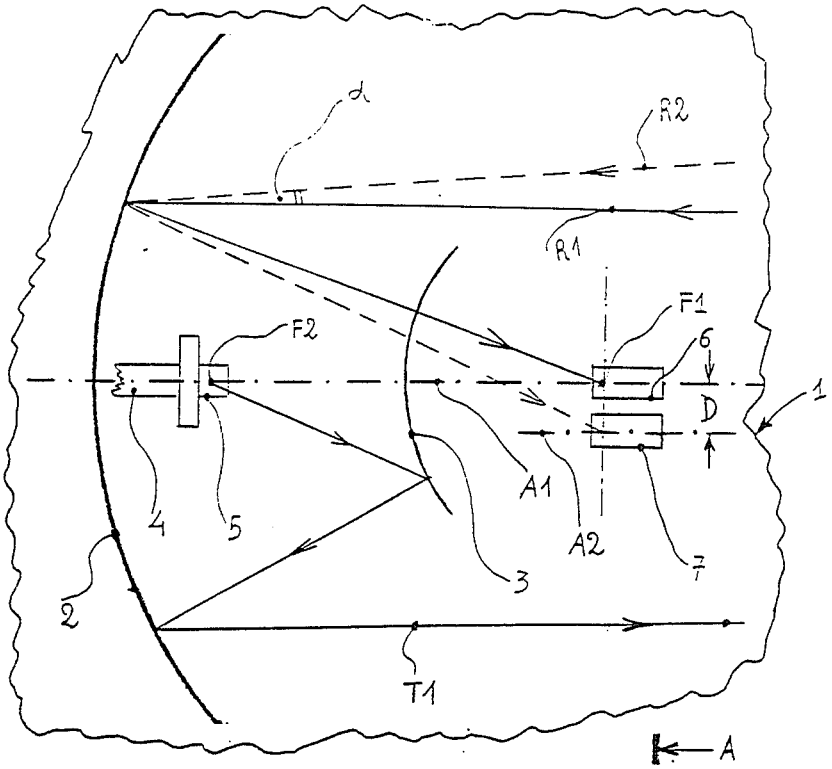
FIG. 1 shows a basic diagram of the radiating system in accordance with the present invention.

With reference to FIG. 1 an angular-diversity radiating system 1 is shown comprising a main reflector with parabolic profile 2 and a subreflector 3 with hyperbolic or linear profile arranged on the optical axis A1 of the main reflector 2. Between the main reflector 2 and the subreflector 3 is a wave guide 4 with circular section partially broken which terminates in a transmitting horn 5. On the concave side of the subreflector 3 is a first receiving horn 6 with its longitudinal axis coinciding with the optical axis A1 and a second receiving horn 7 placed under the first horn 6 parallel thereto and with its longitudinal axis A2 at distance D from A1.

Figure 2:
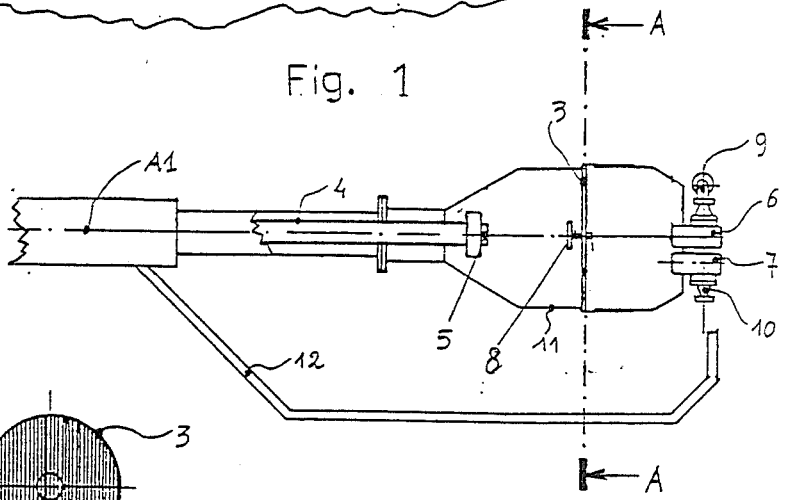
FIG. 2 shows a side view of the antenna horns and the subreflector of the radiating system in accordance with the present invention.

Referring to FIG. 2 wherein the same components as in FIG. 1 are shown with the same reference numbers there is shown a radome 11 made of glass-fiber reinforced resin which provides mechanical support and protection for the antenna horns 5, 6 and 7, the subreflector 3 and the circular wave guide 4, a metal disk 8 for electromagnetic adaptation in transmission arranged on the optical axis A1 at a suitable distance between the transmitting horn 5 and the subreflector 3, two coaxial cable plugs 9 and 10 connected to the two receiving horns 6 and 7, and a support arm 12 for the coaxial cables (not shown in the figure) also of fiberglass reinforced resin connected to the radome 11.

Figure 3:
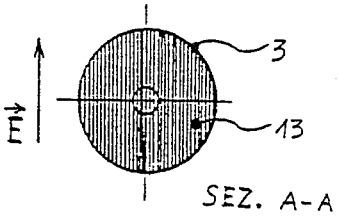
FIG. 3 shows a section along plane A—A of FIG. 2 for a particular polarization case.

Referring to FIG. 3 in which the same components as in FIGS. 1 and 2 are shown with the same reference numbers, it is shown that the subreflector 3 is formed of parallel metal conductors 13. The arrangement of the subreflector 3 is such that the conductors 13 are parallel to the electrical field vector → of the electromagnetic wave issuing from the transmitting horn 5. In the particular example illustrated by FIGS. 1, 2 and 3, the polarization of the transmitted beam is vertical.

Figure 4:
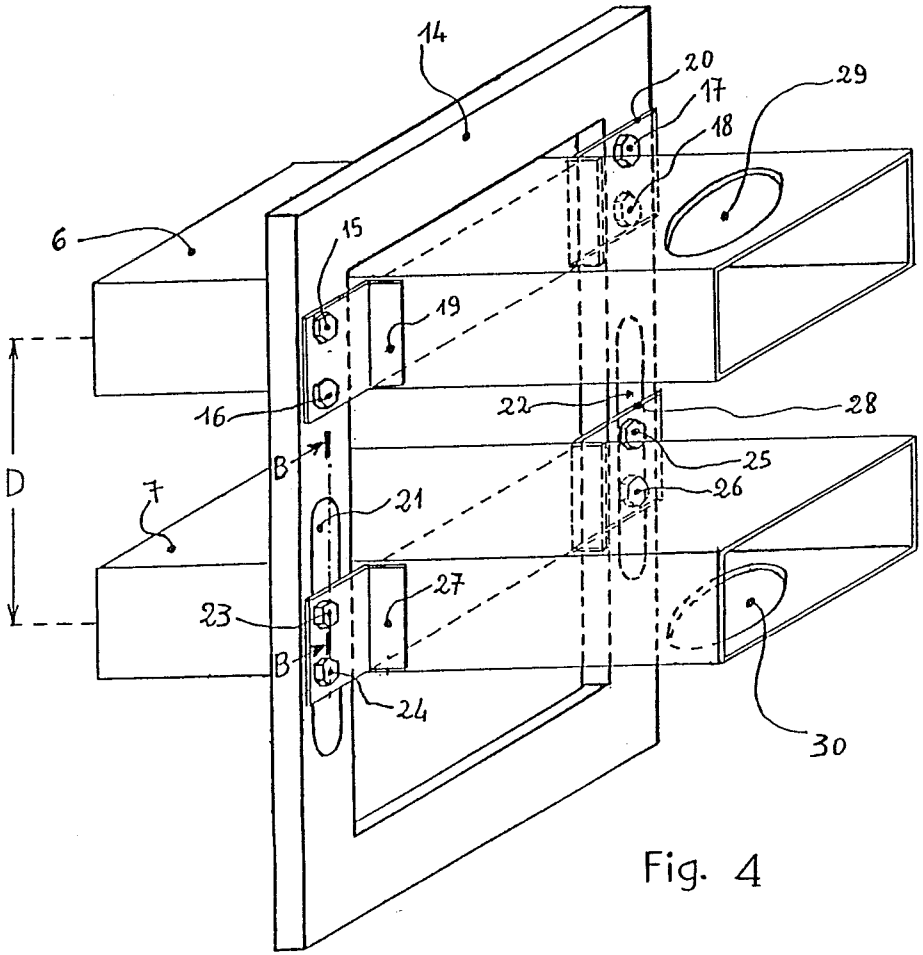
FIG. 4 shows a perspective view of the mechanical means which permits adjustment of the distance between the receiving horns of the radiating system in accordance with the present invention.

Referring to FIG. 4 in which the same components as of FIGS. 1, 2 and 3 are shown with the same reference numbers there is shown a sheet metal flange in the form of a frame 14 connected to the fiberglass reinforced radome not shown in the figure which acts as a support for the two receiving horns 6 and 7. The receiving horn 6 is connected in a fixed manner to the flange 14 by bolts 15, 16, 17 and 18 which penetrate the holes made in two metal fins 19 and 20 welded to the side walls of the receiving horn 6. The receiving horn 7 is connected to the flange 14 in such a manner as to be able to slide and permit adjustment of the distance D between the axes of the two horns 6 and 7. For this purpose in the flange 14 there are made two slots 21 and 22 which permit sliding of the tightening bolts 23, 24, 25 and 26 which penetrate the holes made in two metal fins 27 and 28 welded to the side walls of the receiving horn 7. On the receiving horns 7 are made two holes 29 and 30 for connection of the coaxial cable plugs 9 and 10 (not shown in the Figures) to the horns.

Figure 5:
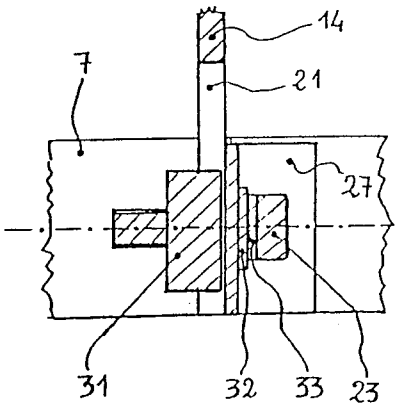
FIG. 5 shows a section along plane B—B of FIG. 4 which illustrates the sliding and locking means of the adjustable receiving horn of the radiating system in accordance with the present invention.

Referring to FIG. 5 in which the same components as in FIGS. 1, 2, 3 and 4 are shown with the same reference numbers it can be seen that the metal fin 27 welded to the side wall of the sliding horn 7 is connected to the flange 14 by a screw 23, a rigid washer 32, an elastic washer 33, and a threaded nut 31. The nut 31 has a protuberance which partially enters the slot 21 and can slide for the entire length of said slot 21.

To better illustrate the operation of the radiating system, it is noted that from the transmitting horn 5 placed in the focus F2 of the subreflector 3 there departs a beam T1 which is first reflected from the subreflector 3 then from the main reflector 2 and finally transmitted while from the receiving side there is a first receiving direction R1 and a second receiving direction R2 forming with the first an angle $\alpha$, termed diversity angle. The signal coming along direction R1 is reflected by the main reflector 2 toward its focus F1 where there is positioned the fixed receiving horn 6 while the signal coming along the direction R2 is reflected at a distance D from the Focus F1 where the adjustable receiving horn 7 is positioned.

In transmission, the radiating system 1 makes a Cassagrain optic with reflectors 2 and 3 and in reception an optic with a single reflector 2 with central focus F1; to permit this the polarization of the transmitted beam T1 is orthogonal to that of the signals coming from the two reception directions R1, R2 and the subreflector 3 is also arranged in such a manner as to reflect the transmitted beam T1 toward the main reflector 2 while it lets pass completely the signals coming from the two reception directions R1, R2 directed toward the horns 6 and 7 respectively.

The Cassegrain optic in transmission is achieved in that the focus F1 of the main reflector with parabolic profile 2 coincides with the internal focus of the subreflector with hyperbolic profile 3 and the external focus F2 of the subreflector 3 coincides with the center of the aperture of the transmitting horn 5. In addition the profile of the hyperbolic subreflector 3 is appropriately shaped to improve the efficiency of the antenna.

Angular diversity in reception is obtained by means of two horns 6 and 7 since each of them establishes its own main lobe in the overall radition diagram. The direction of the two main lobes is indicated by R1 and R2. From FIG. 1 it is apparent how as distance D increases the diversity angle $\alpha$ also increases.

Concerning optimization of the diversity angle $\alpha$ operations must proceed with the following steps in order. (1) Calculate the theoretical distance D' between the longitudinal axes, (2) loosen the four bolts 23, 24, 25 and 26 then with the aid of a graduated rule (not shown in the figures) adjust the receiving horn 7 to the distance D' and tighten the four bolts, (3) accomplish the tropospheric radio connection between the two locations to be linked, (4) record the intensity of the signal received for the entire duration of a predetermined interval of time, (5) again loosen the four bolts 23, 24, 25 and 26 and adjust the receiving horn 7 to a distance D'' slightly smaller (or larger) than D' then tighten the four bolts and adjust the intensity of the signal received for the entire duration of the predetermined time interval, (6) repeat the preceding step several times with decreasing (or increasing) distances in relation to D', and (7) select as distance D which optimizes the diversity angle $\alpha$ the distance which gives the greatest average signal intensity during the entire predetermined time interval.

It is noted how adjustment of distance D between the receiving horns 6 and 7 can be made with continuously and simply and permits optimization of the diversity angle $\alpha$ with extreme precision and simplicity.

The radiating system which is the object of the present invention is thus particularly indicated for mobile radiating systems in which the diversity angle $\alpha$ must be optimized very frequently.

From the description given the advantages of the angular-diversity radiating system of the present invention are apparent. In particular they are represented by the fact that the system as described has a geometrical symmetry in relation to the optical axis A1; permits the employment of antenna horns 5, 6 and 7 of simple fabrication; establishes as concerns transmission only the Cassegrain type optic;

permits accurate positioning of the transmitting horn 5 and the receiving horns 6 and 7 at the predetermined points with the desired accuracy and without mutual superimposition; and displays good efficiency in crossed polarization and permits ready adjustment with continuity of distance D between the longitudinal axis A1 and A2 of the receiving horns 6 and 7 for the purpose of optimizing the diversity angle $\alpha$.

What is claimed is:

1. An angular-diversity radiating system having a main reflector, a subreflector, a transmitting horn and at least two receiving horns wherein said subreflector is centered on the optical axis of the main reflector wherein said transmitting horn is located between said main reflector and said subreflector with its longitudinal symmetry axis coinciding with said optical axis and with the center of its radiating aperture placed at a first predetermined distance from said subreflector and wherein said receiving horns are located on the side opposite that of said subreflector of said transmitting horn and said receiving horns are arranged with their longitudinal symmetry axis parallel to said optical axis;

wherein said subreflector is configured to reflect a beam of linearly polarized electromagnetic waves generated by said transmitting horn and to allow passage of electromagnetic waves which are polarized orthogonally in relation to the transmitted electromagnetic waves and come from at least two reception directions forming between them a desired diversity angle; and wherein said subreflector is comprised of parallel metal conductors which are arranged parallel to the electrical field vector E of said beam of electromagnetic waves generated by said transmitting horn.

2. An angular-diversity radiating system in accordance with claim 1 wherein at least a first one of said receiving horns is arranged with its longitudinal symmetry axis coinciding with said optical axis (A1) and with the center of its radiating aperture located at a second predetermined distance from said subreflector.

3. An angular-diversity radiating system in accordance with claim 2 wherein said first predetermined distance between the center of the radiating aperture of said transmitting horn and said subreflector is the same as said second predetermined distance between said subreflector and the center of the radiating aperture of said first receiving horn and wherein both of said predetermined distances coincide with the distance between the internal or external focal point and the vertex of said subreflector.

4. An angular-diversity radiating system in accordance with claim 1 wherein said main reflector has a parabolic profile.

5. An angular-diversity radiating system in accordance with claim 1 wherein said subreflector has a hyperbolic profile.

6. An angular-diversity radiating system in accordance with claim 1 wherein said subreflector has a linear profile.

7. An angular-diversity radiating system in accordance with claim 1 wherein said subreflector has its internal focal point coinciding with the focus of said main reflector.

8. An angular-diversity radiating system in accordance with claim 1 further including mechanical support and protection means for said receiving and transmitting horns and for said subreflector said means including a radome.

9. A angular-diversity radiating system in accordance with claim 8 wherein said radome is comprised of a fiberglass reinforced resin.

10. An angular-diversity radiating system in accordance with claim 1 further including means for adjusting the distance between said receiving horns.

11. An angular-diversity radiating system in accordance with claim 10 wherein said adjusting means of said distance is configured to permit continuous adjustment of the distance between said receiving horns.

12. An angular-diversity radiating system in accordance with claim 11 wherein said adjusting means of the distance between said receiving horns comprises a flange in the form of a frame having fixedly connected thereto the first receiving horn and to which is connected in an adjustable manner the second receiving horn.

13. An angular-diversity radiating system in accordance with claim 12 wherein said adjusting means between said flange and said second receiving horn includes slots which pass entirely through the thickness of said flange for positioning and securing of said second receiving horn to said flange.

14. An angular-diversity radiating system in accordance with claim 10 wherein said angular-diversity radiating system is mobile.

* * * * *